US006071330A

United States Patent [19]

Matsubara et al.

[11] Patent Number: 6,071,330

[45] Date of Patent: Jun. 6, 2000

[54] ELECTRIC DUST COLLECTOR

[75] Inventors: Makoto Matsubara; Wataru Watanabe, both of Sendai, Japan

[73] Assignee: Galaxy Yugen Kaisha, Sendai, Japan

[21] Appl. No.: 08/817,189

[22] PCT Filed: Aug. 7, 1996

[86] PCT No.: PCT/JP96/02242

§ 371 Date: Jul. 10, 1997

§ 102(e) Date: Jul. 10, 1997

[87] PCT Pub. No.: WO97/05955

PCT Pub. Date: Feb. 20, 1997

[30] Foreign Application Priority Data

Aug. 8, 1995 [JP] Japan ..... 7-224624
Aug. 10, 1995 [JP] Japan ..... 7-009386

[51] Int. Cl.[7] ..... B03C 3/84

[52] U.S. Cl. ..... 96/69; 55/DIG. 38; 96/88; 96/92; 96/97; 96/98; 110/216; 110/345

[58] Field of Search ..... 96/97, 69, 98, 96/88, 92; 110/216, 345; 55/DIG. 38

[56] References Cited

U.S. PATENT DOCUMENTS 617,618 1/1899 Thwaite ..... 55/DIG. 38
1,339,480 5/1920 Schmidt ..... 55/DIG. 38
1,944,523 1/1934 Miller ..... 55/DIG. 38
2,758,666 8/1956 Prentiss ..... 96/97 X
3,656,441 4/1972 Grey et al. ..... 55/DIG. 38
5,041,145 8/1991 Kakinuma et al. ..... 96/97 X
5,217,510 6/1993 Logan et al. ..... 96/97 X
5,254,155 10/1993 Mensi ..... 96/97 X

FOREIGN PATENT DOCUMENTS 53-3113 2/1978 Japan .
6-31199 2/1994 Japan .

*Primary Examiner*—Richard L. Chiesa
*Attorney, Agent, or Firm*—Snider & Associates; Ronald R. Snider

[57] ABSTRACT

An electric dust collector that does not need an exhaust fan or special equipment for preventing dust from flying off. An incinerator is formed on a building, and a smokestack is raised so that it is integrated with the wall of the incinerator. The smokestack is formed from metallic sheeting and lined with refractories. A beam is installed over the smokestack. The beam is electrically insulated using insulatores. A discharge electrode is suspended form the beam at the center of the smokestack. The discharge electrode has many needle-like discharge pins almost in its lower half part. The negative pole of a DC high-voltage power supply is connected with the discharge electrode, while the positive pole is grounded and connected with the metallic sheeting constituting the smokestack.

1 Claim, 3 Drawing Sheets

ELECTRIC DUST COLLECTOR

This application is the National Stage Application filed under 35 USC 371 of International Application No. PCT/JP96/02242 filed on Aug. 7, 1996.

TECHNICAL FIELD

The present invention relates to an electric dust collector also serving as an exhaust pipe lined with refractories.

BACKGROUND ART

Conventional electric dust collectors, used to remove dust from exhaust fumes and exhaust gas from smelting furnaces (steel converters, cupolas, etc.), heat treatment ovens (annealing ovens etc.), ceramics ovens (cement kilns etc.), incinerators, drying ovens, and heat engines, are arranged so that exhaust fumes or exhaust gas passes between many closely spaced dust collecting electrodes. This causes a heavy pressure loss. To prevent an electric dust collector from being exposed to high temperatures, a cooler or the like, also serving as a heat recovery heat exchanger or a gas neutralizer, is normally installed immediately upstream of the electric dust collector, thus increasing pressure loss. Due to pressure loss thus caused, only aeration is not sufficient to emit exhaust fumes or exhaust gas, and accordingly, an exhaust fan is essential for the emission. Because of their exposure to corrosive gas and heat, exhaust fans fail so frequently that they require laborious maintenance and inspection.

In addition, conventional electric dust collectors have the following problems:

(i) Hammering performed to remove dust deposits from collecting electrodes dust to fly off.

(ii) A high gas flow rate aerodynamically causes dust to fly off.

(iii) Dust flies off due to reverse ionization occurring at a high dust electric resistance of more than $10^{12}\Omega\cdot$cm.

(iv) Dust abnormally flies off due to a low dust electric resistance of less than $10^{4}\Omega\cdot$cm.

These problems reduce the rate of dust collection. To avoid the problems, conventional electric dust collectors require the following troublesome countermeasures:

(i) Exhaust fumes and exhaust gas humidity adjustment (ii) Dust collection at a high temperature around 360° C.

(iii) Wet-type dust collection (iv) Pulse charging

It is an object of the present invention to provide an electric dust collector that needs no exhaust fan or special equipment dedicated to prevent dust from flying off.

DISCLOSURE OF THE INVENTION

An exhaust pipe (smokestack) according to the present invention, emitting into the air exhaust fumes from a burning chamber of an incinerator and so on, is made of steel sheeting and lined with refractories, since it is exposed to elevated temperatures due to exhaust fumes. The refractories are preferably castable refractories (refractive concrete composed mainly of $SiO_2$ and $Al_2O_3$) and the like.

The refractories are insulators at normal temperature, which conduct little electric current. During operation, the temperature at the surface of the refractories is around 800° C., and that near heat-resistant anchors preventing the refractories from falling off reaches 400 to 500° C. At such high temperatures, ordinary refractories lose their performance of electric insulation as an ordinary insulating material does. FIG. 1 shows the temperature dependence of a castable refractory.

Corona discharge requires high voltages. Since corona discharge involves a small current, however, the dust collecting electrode does not always need to be as conductive as metal. The electrode is only required to have enough conductivity to discharge collected dust.

According to the present invention, a discharge electrode is suspended at the center of an exhaust pipe, and a high DC voltage is applied between the discharge electrode and the external steel sheeting of the exhaust pipe (the steel sheeting and the discharge electrode have positive and negative polarity, respectively, as in general electric dust collectors).

The collector arranged as described above has a considerably long discharge gap both because the discharge electrode is at the center of the exhaust pipe (smokestack) and because the internal surface of the pipe is a dust collecting electrode. No literature describes in detail corona discharge occurring in such a long gap at high temperatures. Using a small dust collector with a short discharge gap, the inventors made sure that an electric current with two orders or more of magnitude larger flows in a gas at an atmospheric pressure and a temperature of 500 to 700° C. than in a gas at normal temperature when the same voltage is applied. FIG. 2 shows some of the data obtained with the small dust collector. If the discharge gap is long as is the case with the collector, many discharge pins installed in the direction of discharge electrode length allow satisfactory corona discharge to be caused by an ordinary DC high-voltage power supply applying a voltage that is not high relative to the long discharge gap.

For spark discharge, the spark initiating voltage is said to be directly proportional to the product of the discharge gap and the gas density. Even a long discharge gap as is the case with the collector therefore allows the discharge voltage to be high, so that the difference between spark initiating voltage and operating voltage can be set high. Thus safe collector operation can be performed which is free of short-circuiting due to spark discharge.

When corona discharge occurs, gas molecule ionization progresses to produce many cations and anions. Then the cations are immediately neutralized by the discharge electrode, and the anions and electrons run toward the dust collecting electrode. When burnt gas passes through an electric field produced by corona discharge, particles (dust) in the gas are instantaneously charged by collisions of ions and electrons.

The charged dust is attracted to the dust collecting electrode under the effect of the electric field between discharge electrode and dust collecting electrode, that is, the refractories. According to the present invention, the distance between discharge electrode and dust collecting electrode is long, and practical limitations are placed on the voltage of a high-voltage power supply. Thus a strong electric field is difficult to produce, causing charged particles to be weakly attracted to the dust collecting electrode. However, both the discharge and dust collecting electrodes extending along the flow of exhaust fumes, coupled with a low flow rate of exhaust fumes due to a large exhaust pipe cross section, prolong the time required for charged particles to pass through an electric field. This allows a satisfactory dust collecting effect to be exercised even with a weak electric field.

Dust deposited on the dust collecting electrode, the internal surface of the exhaust pipe, peels and falls off under the action of its own weight. For conventional dry-type electric dust collectors, dust deposited on the dust collecting electrode has been removed by periodically hammering or vibrating the electrode. Dust strongly adheres to the dust collecting electrode because dust particles conglomerate with the help of water. According to the present invention, dust is exposed to high temperatures, thus removing water therefrom, so that dust particles bond together into large conglomerations due to an electrode conglomeration effect and fall off under the action of their own weight without being deposited on the dust collecting electrode to form a thick layer.

The present invention allows an exhaust pipe to have so large a cross section that the flow rate of exhaust fumes can satisfactorily be reduced, thus preventing dust collected from flying off due to aerodynamic effects.

It is natural that the present invention can also be applied to a small dust collector having an exhaust pipe with little exhaust fumes and a small cross section. As can be seen from the data in FIG. 2, a small dust collector has a relatively short discharge gap, and the refractories in the collector reach high temperatures. Accordingly, its operating voltage can be reduced, compared with conventional electric dust collectors. This allows the power supply and insulating means to be simplified.

It is well known that installing tipped discharge pins with a large radius of curvature to the discharge electrode promotes corona discharge. When the present invention is applied to a dust collector with a long discharge gap, the operating voltage can be reduced by installing many discharge pins to the discharge electrode.

When the present invention is applied to a dust collector with a short discharge gap, choosing the number of discharge pins and their shape as desired allows the operating voltage to be changed.

The exhaust pipe may be formed independently of the burning chamber. The exhaust pipe can be installed immediately under the burning chamber to help remove dust deposits peeling off the internal surface of the exhaust pipe by taking the deposits together with ash on the burning chamber floor out of the collector. This eliminates the need for a hopper receiving dust peels. The flow rate of exhaust fumes in the exhaust pipe is so low that dust peeling off the internal surface of the exhaust pipe slowly falls along the wall.

For conventional dry-type electric dust collectors, if the electric resistance of dust is high, it may undergo reverse ionization, thus flying off from the dust collecting electrode. The higher the temperature, the lower the electric resistance of dust. According to the present invention, however, dust collecting is performed directly from exhaust fumes of high temperature in the exhaust pipe. Therefore, the electric resistance of dust is kept so low that dust hardly flies off due to reverse ionization. In addition, since the dust collecting electrode, or refractories, of a dust collector according to the present invention is not completely conductive, the charge on the dust collecting electrode is slowly neutralized in a long time even if the electric resistance of dust is low. Thus dust is further inhibited from flying off due to a low dust resistivity.

The present invention has advantages below.

A first electric dust collector according to the present invention is adapted to support a discharge electrode almost in the axis of an exhaust pipe and to apply a DC voltage between the discharge electrode and the metal sheeting constituting the exhaust pipe. The exhaust pipe is filled with high-temperature exhaust fumes. Thus the first electric dust collector can attract dust to the refractories inside the exhaust pipe, the refractories becoming conductive at elevated temperatures, by charging the dust using corona discharge caused between the discharge electrode and the internal surface of the exhaust pipe at a lower voltage than when the exhaust pipe is filled with low-temperature exhaust fumes. The first electric dust collector is simple and requires only a low operating cost. The collector is also easy to maintain because it does not need an exhaust fan or special equipment preventing dust from flying off.

A second electric dust collector according to the present invention has discharge pins around a discharge electrode. Even if the second dust collector has a long discharge gap, the discharge pins, coupled with ease of corona discharge at high temperatures, allow the second dust collector to be satisfactorily operated using an ordinary DC high-voltage power supply producing a voltage which is not significantly high.

If the discharge gap is not considerably long, the number of discharge pins and their shape can be chosen to vary the operating voltage, so that the second dust collector can be operated according to the limits on the length of the discharge electrode and dust collecting electrode measured along the direction of the flow of exhaust fumes, the power supply, insulation, and exhaust fume temperature.

A third electric dust collector according to the present invention has an exhaust pipe which is aligned with a burning chamber and integrated with the wall of the burning chamber. Being so arranged, the third dust collector allows dust caught on a dust collecting electrode to directly fall into the burning chamber after it peels off. This eliminates the need for a hopper receiving dust and allows dust fallen into the burning chamber to be conveniently discarded together with ash in the burning chamber.

A fourth electric dust collector according to the present invention has a beam installed over a structure independent of an exhaust pipe, from which beam a discharge electrode is suspended into the exhaust pipe. Although simple, the beam has an advantage of supporting the discharge electrode at the center of the exhaust pipe while ensuring insulation.

BEST MODE FOR CARRYING OUT THE INVENTION

Figure 3:
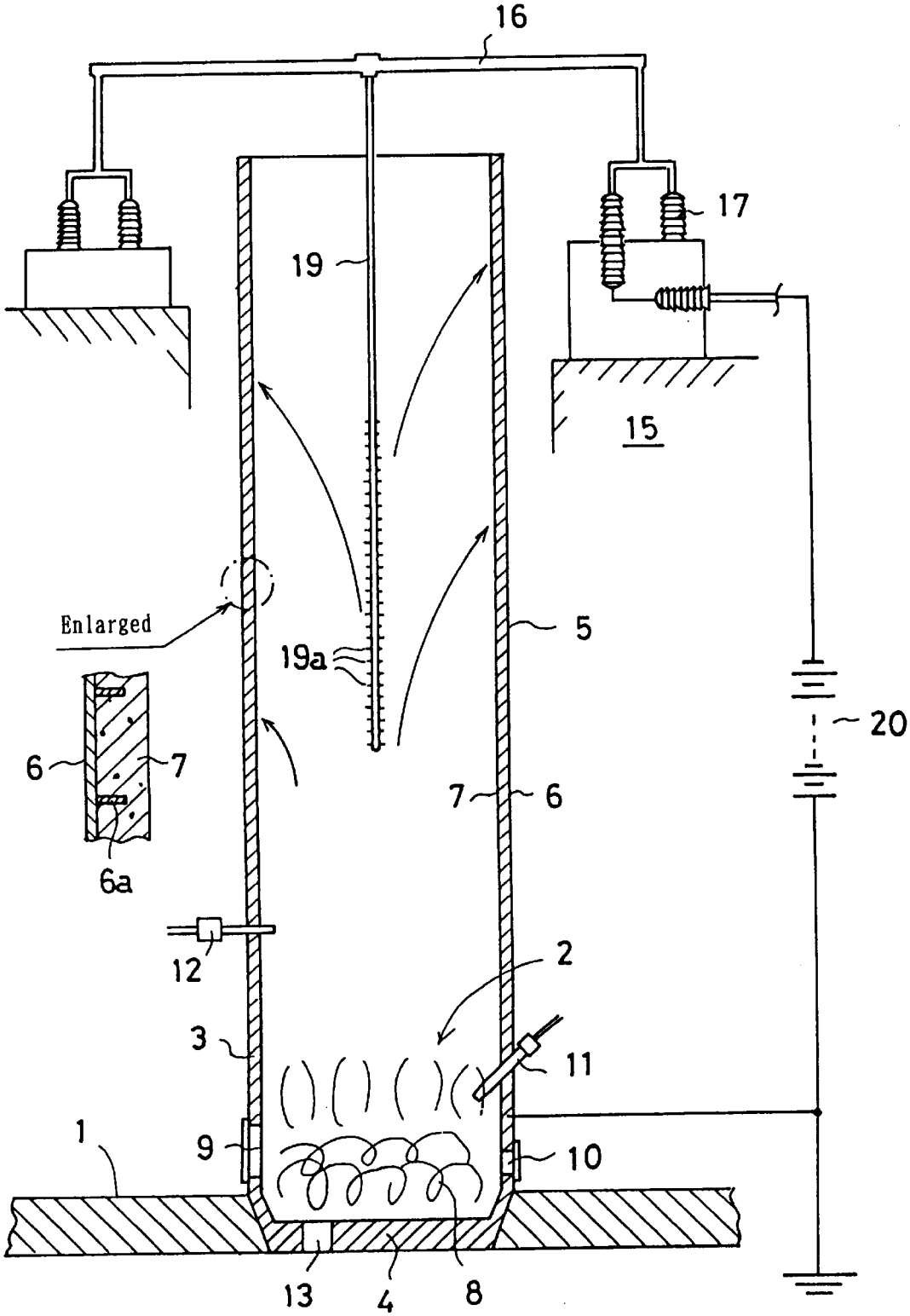
FIG. 3 is a cross-sectional schematic of an electric dust collector according to the present invention.

Referring now to FIG. 3 showing an embodiment, an incinerator to which the present invention is applied, the incinerator 2 is formed as a burning chamber on top of a building 1, and a smokestack 5, an exhaust pipe, is raised so that the smokestack is integrated with an incinerator wall 3. The smokestack 5, round in cross section, is made of steel sheeting 6 and lined with castable refractories 7. To prevent the castable refractories 7 from falling off, many heat-resistant metallic anchors 6*a* are installed on the internal surface of the steel sheeting 6.

The incinerator wall 3 is provided with a feed opening 9 for feeding waste 8 in the incinerator, an air intake 10, an auxiliary burner 11, and an alkaline solution spray 12 for neutralizing gas, and the incinerator floor 4 is provided with an ash outlet 13.

A structure 15 independent of the smokestack 5 is installed on top of the building 1 to place a beam 16 over the smokestack 5, using the structure. The beam 16 is electrically insulated using insulators 17. A discharge electrode 19 is suspended from the beam 16 so that the discharge electrode is at the center of the smokestack 5. The discharge electrode 19 has many needle-like discharge pins 19*a* almost in its lower half part.

Figure 1:
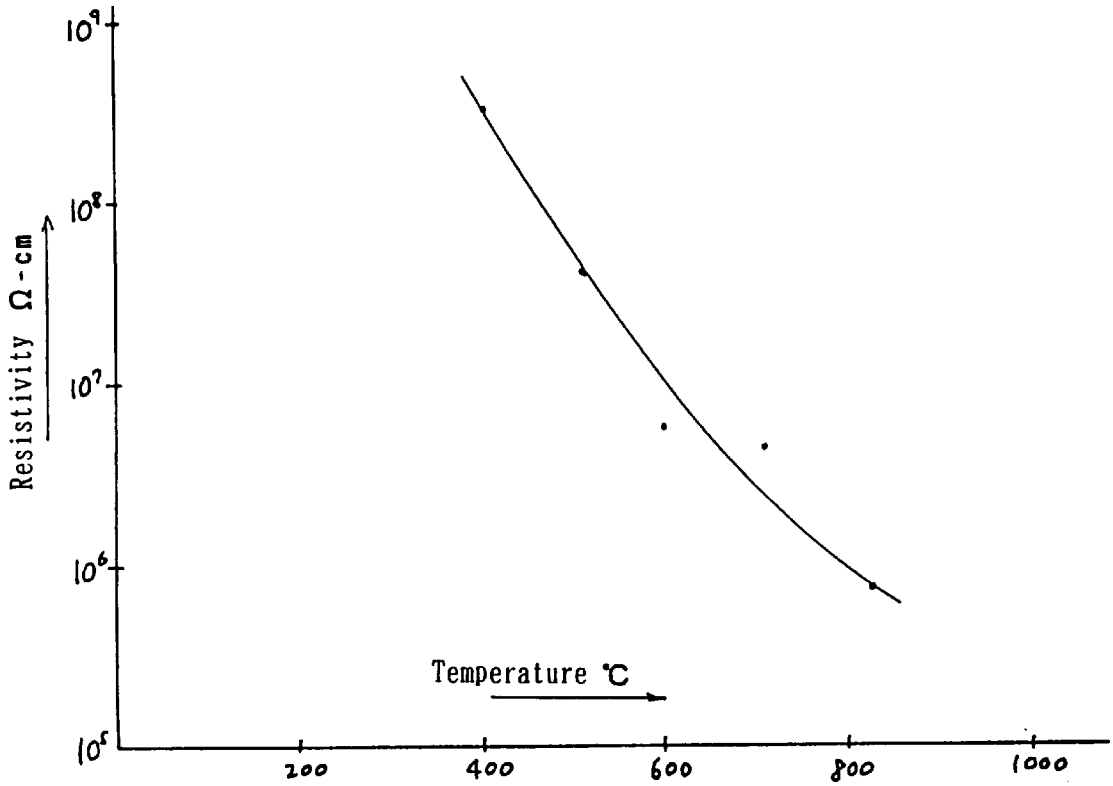
FIG. 1 is a graph showing the electric resistance-temperature characteristic of a castable refractory.
Figure 2:
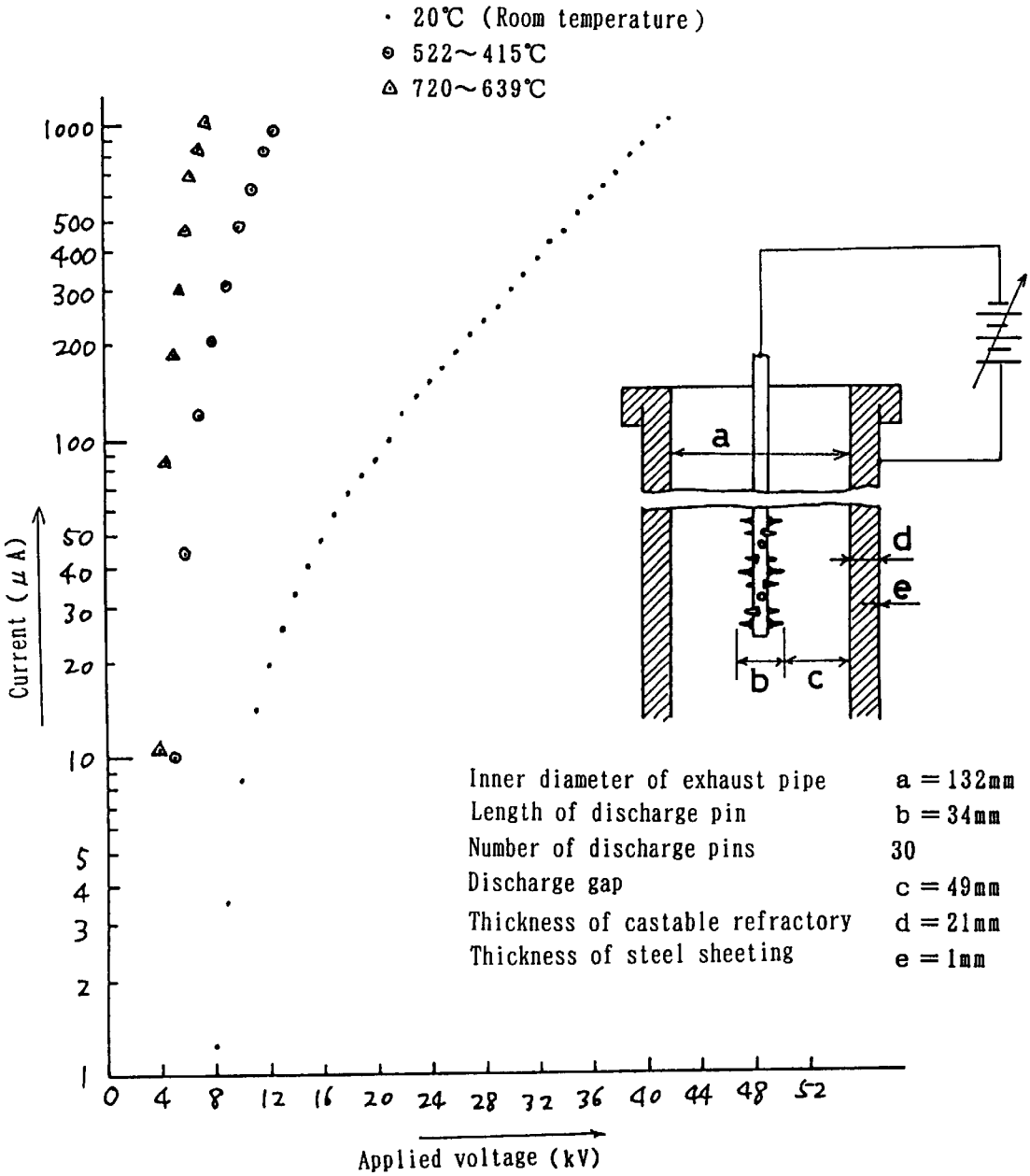
FIG. 2 is the discharge voltage-current curve of a smokestack lined with castable refractories.

The negative pole of a DC high-voltage power supply 20 is connected with the discharge electrode, while the positive pole is grounded and connected with the steel sheeting 6 constituting the smokestack. When the waste 8 is burned on the incinerator floor 4, high-temperature exhaust fumes pass through the smokestack 5 and leave it at its top end. The smokestack is filled with exhaust fumes, and corona discharge occurs between the castable refractories 7, serving as a dust collecting electrode, and the discharge electrode 19. Dust in burnt gas is charged by corona discharge and attracted to the internal surface, or the dust collecting electrode, of the smokestack. Then the dust is deposited on the castable refractories 7, which have been exposed to exhaust fumes and reached high temperature, losing the performance of electrical insulation. As a result, the dust is neutralized. In FIG. 2, an arrow indicates the motion of the charged dust. The dust deposited on the internal surface of the smokestack peels off under the action of its own weight and falls along the internal surface onto the incinerator floor.

Exhaust fumes from which dust has been removed as described above are emitted at the outlet of the smokestack.

In the above embodiment, the smokestack is installed so that it is aligned with the incinerator and integrated with the wall thereof. The present invention, however, is not limited to such arrangements. The incinerator may be separated from the smokestack.

Industrial Applicability

An electric dust collector according to the present invention is useful for incinerators.

What is claimed is:

1. An electric dust collector comprising:

an exhaust pipe for emitting high-temperature exhaust fumes, whose internal surface formed from metallic sheeting is lined with refractories, a discharge electrode supported substantially alone the central axis of the exhaust pipe so that the discharge electrode is electrically insulated from the exhaust pipe, a high-voltage power supply for applying a high DC voltage between the discharge electrode and the metallic sheeting, wherein the discharge electrode has discharge pins around, wherein the exhaust pipe is installed to be aligned with a central axis as a burning chamber and integrated with the wall of the burning chamber, and wherein a beam is installed over a structure independently of the exhaust pipe so that the beam crosses over the outlet of the exhaust pipe, and the discharge electrode is suspended from the beam into the exhaust pipe.

* * * * *